US007771566B2

(12) United States Patent
Hilbig et al.

(10) Patent No.: US 7,771,566 B2
(45) Date of Patent: Aug. 10, 2010

(54) EMBOSSED MULTI-PLY TISSUE HAVING A SOFTENING LOTION

(75) Inventors: Klaus Hilbig, Frankfurt (DE); Oliver Horst Heilmann, Bad Soden (DE); Martin Robert Ernest Leal, Guildford (GB); Norbert Meyer, Saffig (DE); Matthias Morand, Bad Soden (DE)

(73) Assignee: The Procter + Gamble Company, Cincinnati, OH (US)

( * ) Notice: Subject to any disclaimer, the term of this patent is extended or adjusted under 35 U.S.C. 154(b) by 118 days.

(21) Appl. No.: 12/157,496

(22) Filed: Jun. 11, 2008

(65) Prior Publication Data

US 2008/0314535 A1 Dec. 25, 2008

Related U.S. Application Data

(63) Continuation of application No. PCT/IB2007/052541, filed on Jun. 29, 2007.

(30) Foreign Application Priority Data

Jul. 11, 2006 (EP) ..... 06116936

(51) Int. Cl.
*D21H 27/30* (2006.01)
*B31F 1/07* (2006.01)
*B32B 29/00* (2006.01)

(52) U.S. Cl. ..... 162/117; 162/123; 162/125; 162/135; 162/158; 162/179; 428/156; 428/172; 424/402

(58) Field of Classification Search ..... 162/109, 162/117, 123, 125, 132, 158, 179; 428/156, 428/172, 537.5; 156/209, 219; 424/402
See application file for complete search history.

(56) References Cited

U.S. PATENT DOCUMENTS 3,738,905 A * 6/1973 Thomas ..... 428/154
3,868,205 A * 2/1975 Thomas ..... 425/363
3,953,638 A * 4/1976 Kemp ..... 428/154
3,958,055 A * 5/1976 Hadley et al. ..... 428/198
3,961,119 A * 6/1976 Thomas ..... 428/178
5,693,406 A * 12/1997 Wegele et al. ..... 428/179
5,755,654 A * 5/1998 Schulz et al. ..... 493/350
6,423,397 B1 * 7/2002 Roussel ..... 428/156
6,544,386 B1 * 4/2003 Krzysik et al. ..... 162/123
6,599,614 B1 * 7/2003 Roussel et al. ..... 428/172
6,602,577 B1 * 8/2003 Ostendorf et al. ..... 428/156
6,656,569 B1 * 12/2003 Roussel et al. ..... 428/154
6,733,866 B2 * 5/2004 Muller ..... 428/172
7,407,560 B2 * 8/2008 Hilbig et al. ..... 162/123
2002/0153110 A1 10/2002 Yamaguchi et al.
2003/0026953 A1 * 2/2003 Muller ..... 428/174
2003/0116291 A1 * 6/2003 Zoeller et al. ..... 162/123
2004/0003905 A1 * 1/2004 Hilbig et al. ..... 162/117
2004/0055721 A1 * 3/2004 Hilbig et al. ..... 162/117
2005/0082022 A1 * 4/2005 Zoller et al. ..... 162/111
2008/0314535 A1 * 12/2008 Hilbig et al. ..... 162/109
2009/0056892 A1 * 3/2009 Rekoske et al. ..... 162/111

FOREIGN PATENT DOCUMENTS

EP 1 233 107 A1 8/2002
EP 1232854 A1 * 8/2002
EP 1 365 068 A1 11/2003
EP 1878830 A1 * 1/2008
WO WO 9906634 A1 * 2/1999
WO WO 0190481 A1 * 11/2001
WO WO 2005/080677 A2 6/2005
WO WO 2008007289 A2 * 1/2008

OTHER PUBLICATIONS

PCT International Search Report Mailed Jan. 22, 2008.

* cited by examiner

*Primary Examiner*—José A Fortuna
(74) *Attorney, Agent, or Firm*—Betty J. Zea; Andrew A. Paul

(57) ABSTRACT

A multiply tissue article having a softening lotion and an embossment of the external surface. The embossment forms a network of discrete depressions. The embossment has particular configuration and induces a ply separation force within a defined range. The multiply tissue exhibits enhanced performance for softness, strength and ply delamination. The invention also relates to the process of making such a multiply article.

20 Claims, 6 Drawing Sheets

EMBOSSED MULTI-PLY TISSUE HAVING A SOFTENING LOTION

CROSS REFERENCE TO RELATED APPLICATION

This application is a continuation application of prior co-pending International Application No. PCT/IB2007/052541, filed on Jun. 29, 2007, designating the U.S.

FIELD OF THE INVENTION

This invention relates to the field of multiply tissue articles and the related methods to make. More specifically it relates to multiply tissue articles comprising a softening lotion and being embossed.

BACKGROUND OF THE INVENTION

Multiply tissue articles are well-known and can be provided for a variety of use. Most generally multiply tissue articles comprise at least one ply of paper tissue having a majority of cellulosic fibers. Examples of multiply tissue articles include paper handkerchiefs, kitchen towels, and toilet paper. In many cases multiply tissue articles comprise a multiplicity of tissue plies, each of them being of cellulosic nature.

As multiply tissue articles are in most cases intended to be put in contact with human skin, one important characteristic of multiply tissue articles is the softness, more specifically the surface softness. Softness, smoothness and low surface friction are very important characteristics together with bulkiness, thickness, resistance, dry-strength and wet-strength. Each intended use dictates a specific optimum balance between the above properties.

Another important property, related to the multiply nature of such articles is ply bonding force (also called separation force). Separation of the plies in use (also called ply delamination) is often perceived as a negative impairing the quality of the article. Adequate ply bonding is required for maintaining the plies together during the manufacturing, before the use and during the usage of the article.

Ply bonding can be conventionally enhanced by the application of a layer of adhesive between the plies. Also conventionally ply bonding can be promoted by embossing the plies together. Embossing creates interlacing of the fibers (mechanical bonding), and can conventionally enhance the hydrogen-type bonds between the fibers in the embossment sites. In general conventional ply bonding impacts the softness of the multiply tissue: The presence of adhesive and/or the embossments can create zones of stiffness impairing the desired quality of the multiply tissue.

Conventional multiply tissue articles can comprise a softening lotion. The lotion is in many cases present on at least one of the outwardly oriented surfaces of the multiply article. It reduces the surface friction and hence helps deliver softness and smoothness when the article is rubbed against human skin.

The presence of a lotion however renders the risk of delamination more acute. Softening lotions, in most cases, impair the adhesion of the plies to each other and decreases of the effect of many ply bonding means (i.e. embossments or adhesive).

To reduce the risk of delamination, the embossed zones can be physically separated from the lotioned zones. Alternatively, the embossing conditions such as pressure and temperature are carefully selected to minimize delamination.

There is a need for a multiply tissue article that exhibits a high level of softness and smoothness while presenting high bulkiness and while maintaining enhanced tensile strength. Further, there is a need for a multiply tissue article that does not delaminate in use. Moreover, there is a need for a multiply tissue article delivering optimum balances of softness, smoothness, tensile strength, ply bonding, bulkiness and comfort while using less material, for example by comprising a relatively low number of plies of lower basis weight in comparison to similar articles delivering the same range of properties.

There is a need for a multiply tissue article that balances the above properties in order to deliver an enhanced perception by the users.

SUMMARY OF THE INVENTION

The invention relates to a multiply tissue comprising a first and a second ply. The first ply comprises an external surface of the article. The article comprises a softening lotion, preferably silicon-based, and an embossment of one external surface. The embossment forms a network of discrete depressions. The total surface of the depressions is between 0.2% and 8% of the total surface of the article. The network of discrete depressions is between 60% and 100% of the surface area of the article. The first ply exhibits a separation force of between 0.8 N/m and 20 N/m when being separated from the article. In one embodiment the depressions are evenly distributed within the network and the average surface of the depression may be comprised between 0.01 sqmm and 16 sqmm. The invention also relates to the process of making such a multiply article.

DETAILED DESCRIPTION OF THE INVENTION

Definitions

Figure 1:
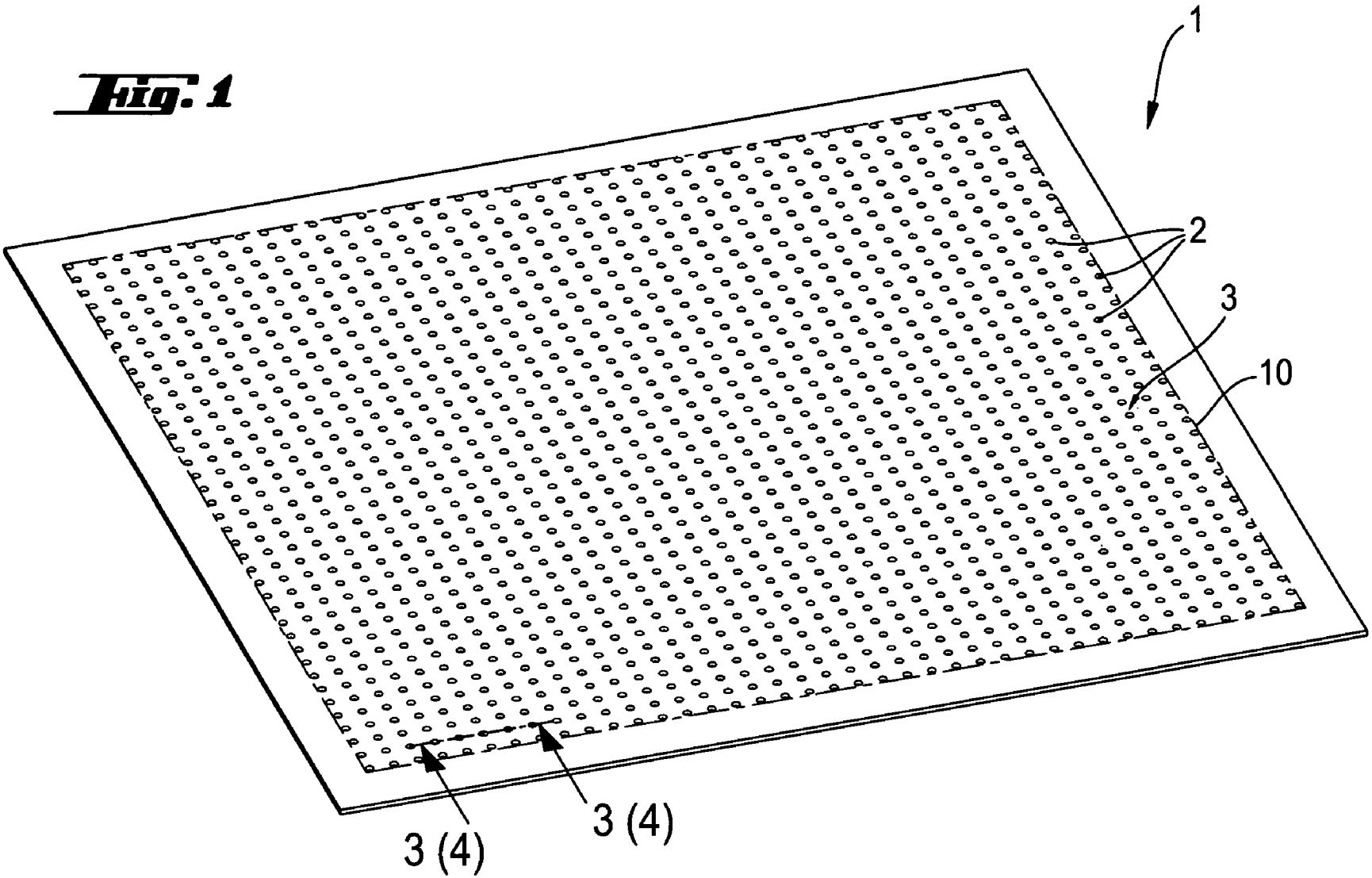
FIG. 1 is a schematic perspective view of a multiply tissue article of the invention showing the coverage of the embossment.

For the purpose of the present invention, the following terms are given the meaning provided hereunder.

"Tissue" is substantially flat and made of a substantially absorbing material. In regard to the invention, tissues include cellulosic substrates such as those conventionally used in paper towels, paper handkerchiefs, kitchen towels, toilet papers and the like. Tissues can also comprise non cellulosic material such as polypropylene and/or polyethylene fibers, and/or starch or starch derivatives and/or cellulose-derived materials such as viscose or Lyocell fibers. Examples of tissue articles comprising such non cellulosic materials include all sort of wiping articles such as baby, kids or adults wipes, hard surface cleaning wipes, cosmetic wipes or wipes intended to deposit an active on the wiped surfaces. Mixtures of cellulosic and non-cellulosic fibers are also contemplated in the tissues of the invention. Typical tissues are paper tissues manufactured from of a web of cellulosic fibers. Several plies of tissue can be assembled together to obtain a multiply tissue. Examples of tissue plies suitable for the present invention are manufactured by a conventional wet-layering of fibers such as conventional paper-making or through-air dried paper-making. Alternatively tissues suitable for the invention can also be made by dry layering of fibers or by a combination of wet-layering and dry-layering. In one embodiment of the invention the tissue is a paper tissue comprising a majority of cellulose fibers. In another embodiment the fibers of the tissue are all natural fibers. In another embodiment the cellulose fibers are natural cellulose fibers, preferably wood cellulose fibers. The wood cellulose fibers can be relatively long fibers or relatively short fibers or mixture thereof.

Multiply tissue articles: Typical multiply tissue articles are paper handkerchiefs, kitchen towels and toilet papers. Other multiply tissue articles can be contemplated within the scope of this invention. Multiply tissue articles comprise at least one above described tissue.

Network of discrete depressions: The embossment of a tissue impresses tri-dimensional depressions onto the surface of the tissue. Typically the embossments are repeated at a given interval and induced by the protrusions or protuberances on the surface of the embossment rolls in a typical embossment process. The embossment hence forms a network of discrete depressions on the surface of the tissue. Less than the entirety of the surface of the article can be covered by the network of depressions, leaving a portion of the surface of the article without embossments. The periphery or contour of the network is defined by the smallest polygon including all the depressions. In case the surface of the tissue comprises one or more zones without any depression, these zones are to not be considered as part of the network. By definition, the surface area of the network of discrete depressions is the surface area of the said polygon minus the surface area of the zones without any depression.

Multiply Tissues

The article of the invention can be a paper handkerchiefs, a paper towel, kitchen towel, toilet paper, dry or wet wipes or any other article provided that at least one ply is a tissue ply. In one embodiment all plies are tissue plies and/or all plies are made by a wet layering process using a majority of or exclusively wood fibers and/or the article is a paper handkerchief.

The shape of the article can be any shape suitable for the intended usage. Square, rectangular, triangular, circular, oval articles can be contemplated. Typically however, there is a cost benefit at providing an article that is square or rectangular (as this has a better usage of the material without material loss).

The dimensions of the article can be any dimensions providing an adequate size for the intended usage. Typically the article of the invention has a size not exceeding 50 cm or 30 cm in its largest dimension. Typically dimensions (expressed at length×width) are less than 40 cm×30 cm or less than 25 cm×20 cm. Typically the smallest dimension of the article is greater than 5 cm. In some embodiments the dimensions (expressed at length×width) are more than 10 cm×7 cm or more than 15 cm×10 cm.

The caliper of the article of the invention can be any caliper suitable for the intended use. Typical caliper of the article of the invention can be between 0.1 mm and 5 mm, or between 0.2 mm and 1 mm. The caliper is measured in absence of any compression of the article.

The multiply tissue article of the invention comprise at least a first and a second ply. The article according to the invention can comprise more than one ply, for example 3 or 4 plies.

The plies of the article can be of identical, similar or different nature (for example one tissue ply and one non-tissue ply). The plies of the article of the invention can be homogeneous or can have a heterogeneous nature. Specifically the tissue ply/plies can be homogeneous in a z-direction in their fiber composition. Alternatively the tissue ply/plies can be heterogeneous. Layered tissues are contemplated to form a tissue ply for the invention.

The plies used in the invention are substantially flat and have 2 dimensions (conventionally defined as x, y or machine direction (MD) and cross direction (CD)) much greater than the third dimension (z-dimension). Hence the plies of the invention each have 2 surfaces. The multiply article of the invention has two external surfaces, defined by the outwardly oriented surfaces of the most external plies of the multiply article.

The typical basis weight of the article of the invention is between 10 gsm (gram per square meter) and 80 gsm, or between 20 gsm and 60 gsm. While article of very high basis weight are more costly to manufacture and may be of lesser flexibility/softness, articles of very low basis weight may be of lesser resistance to tear and/or or lesser absorbency. In some embodiment of the invention the plies of the articles have individual basis weight between 8 gsm and 30 gsm, for example 10, 15, 18, or 22 gsm.

The first ply of the article comprises one external surface of the article. The external surface of the article comprises an embossment. An embossment is conventionally created by applying a 3-dimensional pattern under pressure onto the surface of a tissue. The tissue is passed trough a nip created between a first embossing roll bearing an engraved 3 dimensional pattern and a second roll. The rolls can be loaded with a defined pressure and can be heated to enhance the embossing of the tissue. The second embossing roll can be of similar nature (e.g. hard surface) to the first roll or can be of a different nature (e.g. rubber roll with first roll having a hard surface). The second roll can have a 3-dimensional patterned surface or can be flat.

The embossment forms depressions at the surface of the ply. Depressions are depressed relative to their immediate non-embossed surrounding. In other words this means that the depressions have a depth in the z-direction. That depth exceeds the average z-direction variability of the non-embossed areas (although the ply is substantially plane, small variations in the z-directions are to be expected). The depth of a depression is measured (by any conventional method) from the average plane of the surface of the ply to the deepest point of the depression. An average is calculated from series of measurements.

The depressions can be of any depth. In one embodiment however the average depth is such as to not create a discontinuity of the surface of the ply, such as holes and tears. In some embodiments the depth is between 20 μm and 500 μm. The depth can be between 50 μm and 300 μm. Enhanced benefits of the invention have been demonstrated with a depth between 80 μm and 180 μm.

The depressions can be of any shape. Round, square, rectangular, triangular, oval-shaped depressions are all possible in various embodiments of the invention. The depressions being individually separated from each other are said to be discrete depressions. More complex shapes are also possible. Depressions of various shapes and dimensions can co-exist at the surface of an article. In one embodiment, all the depressions of the article are of identical or of substantially identical shape and/or dimensions. In another embodiment, 2 groups of depressions are present and the depressions are substantially identical within each group. In another embodiment, 3, 4 or 5 groups of depressions are present and the depressions are substantially identical within each group. In one embodiment the depressions of the first group are of larger surface area and/or deeper than the depression of the second group. In one embodiment the depressions of the first group are more elongated (one dimension substantially greater than the other dimension) than the depressions of the second group.

Although the depressions can have any shape, they are discrete. At least 2 individual depressions are present and they can be identified in isolation from another. In particular embodiments, the number of depressions on the external surface of the ply of the article is equal to or higher than 100, 500 or 4000. The density of discrete depressions (number of individual discrete depression per unit of surface area) can be more than 0.25 depression per sqcm, more than 10 depressions per sqcm, or more than 100 depressions per sqcm. In some embodiments the density is however less than 200, 150, or 50 depressions per sqcm. In one embodiment the density is 10 depressions per sqcm.

Individual discrete depression can have one dimension (in the plane of the tissue) equal or more than 0.01 mm, 0.1 or 1 mm. The second dimension (in the plane of the tissue) can also be equal or more than 0.01 mm, 0.1 mm or 1 mm. In one embodiment the depressions have one dimension (in the plane of the tissue) between 0.01 mm and 2 mm and the second dimension (in the plane of the tissue) between 5 mm and 20 mm.

The size and the shape of the depressions can be identical along the depth of the depressions (for example when the depressions have straight walls). Alternatively the shape and/or the size of the depressions at the surface of the ply (corresponding to the proximal ends of the embossment protuberances on the embossing roll) can be different from the shape and/or the size of the depressions at the maximal depth (corresponding to the distal ends of the embossment protuberances of the embossing roll). In one embodiment, the walls of the embossment areas are inclined such as to form depressions having smaller surface area at the deepest (distal) end than at the ply surface (proximal end). In one embodiment the surface area at the deepest (distal) end is less than 60% of the surface area at the ply surface (proximal end). In other embodiments that ratio can be less than 50%, or less than 30%. The calculation of the surface area of the depressions is detailed below.

The group of depressions formed by the embossment at the surface of the ply of the article form, together with their immediate non-embossed surrounding, a network of discrete depressions. In other words the surface of the ply can have 2 regions: One region comprising the (discrete) depressions (defining the network of discrete depressions) and one region free of any (discrete) depression. The network of discrete depressions is defined by the smallest convex polygon comprising all discrete depressions.

Softening Lotion

The article of the invention comprises a softening lotion. In one embodiment the softening lotion is available at one external surface of the article. Alternatively, the softening lotion is available at the external surface of the article that also comprises the embossment. In an embodiment the softening lotion is solely or prevalently available at the external surface of the article comprising the embossment. The softening lotion can be present inside the plies and/or at their surface. The inner surfaces of the article can also have some softening lotion although the lotion is there less functional. There is indeed an advantage (functionality and cost) to have the lotion available at the external surface(s) of the article—these surface(s) are indeed typically the surfaces in contact with the users' skin during use.

A softening lotion is a composition intended to reduce the coefficient of friction of the surface of the article. It is of particular importance when the friction is considered as a frictional interaction with a human (user's) skin. The softening lotion helps to create a more pleasant feel and touch and can also enhance the flexibility as well as the softness of the article.

In one embodiment, the tissue article may comprise from 1% to 25% (weight/weight) of the softening lotion. When the softening lotion comprises a silicone-based softening agent or a quaternary ammonium-based softening agent, the tissue article can comprise from 2% to 15% (weight/weight) of the softening lotion and/or between 3% to 6% (weight/weight). When the softening lotion comprises a wax softening agent, the tissue article can comprise from 5% to 20% (weight/weight) of the softening lotion, in another embodiment between 7% to 15% (weight/weight).

The softening lotion comprises a softening agent that is the primary active compound of the softening lotion. Multiple active compounds can be present in the softening lotion. In one embodiment of the invention the softening lotion is a silicon-based softening lotion. In other embodiments the softening lotion is based on quaternary ammonium compounds, or on waxes.

In one example, the softening lotion comprises from 0.01% to 100% (weight/weight) of a softening agent. In some embodiments, the softening lotion comprises from 1% to 80% (weight/weight) of a softening agent. In other embodiments, the softening lotion comprises from 5% to 20% (weight/weight) of a softening agent.

The softening properties of the lotion are thought to be primarily linked to the amount of softening agent present in or on the tissue article. In some embodiments, the softening agent is from 0.02% to 25% (weight/weight) of the tissue article. When the softening agent is a silicone-based softening agent, the tissue article can comprise from 0.1% to 2% (weight/weight) of the softening agent. When the softening agent is a quaternary ammonium-based softening agent, the tissue article can comprise from 0.2% to 4% (weight/weight) of the softening agent. When the softening agent is a wax softening agent, the tissue article can comprise from 3% to 25% (weight/weight) of the softening agent and/or 7% to 15% (weight/weight).

In one example, the softening lotion of the present invention is a micro emulsion of a softening agent (for example an amino functional polydimethylsiloxane) in water. Suitable micro emulsions are commercially available from Wacker Chemie, Dow Corning and/or General Electric Silicones.

Typical suitable softening agents can be selected from the group consisting of: polymers such as polyethylene and derivatives thereof, hydrocarbons, waxes, oils, silicones (polysiloxanes), quaternary ammonium compounds, fluorocarbons, substituted $C_{10}$-$C_{22}$ alkanes, substituted $C_{10}$-$C_{22}$ alkenes, in particular derivatives of fatty alcohols and fatty acids (such as fatty acid amides, fatty acid condensates and fatty alcohol condensates), polyols, derivatives of polyols (such as esters and ethers), sugar derivatives (such as ethers and esters), polyglycols (such as polyethyleneglycol) and mixtures thereof.

Other typical softening agents of the wax family may be selected from the group consisting of: paraffin, polyethylene waxes, beeswax and mixtures thereof.

Other typical softening agents of the silicone and non silicone oils families may be selected from the group comprising mineral oil, silicone oil, silicone gels, petrolatum and mixtures thereof.

Typical examples of suitable silicones (polysiloxanes) may be selected from the group comprising polydimethylsiloxanes, aminosilicones, cationic silicones, quaternary silicones, silicone betaines, dimethicone and mixtures thereof.

Other examples of suitable polysiloxanes and/or monomeric/oligomeric units may be selected from the compounds having monomeric siloxane units of the following structure:

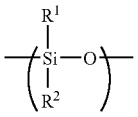

wherein, $R^1$ and $R^2$, for each independent siloxane monomeric unit can each independently be hydrogen or any alkyl, aryl, alkenyl, alkaryl, arakyl, cycloalkyl, halogenated hydrocarbon, or other radical. Any of such radical can be substituted or unsubstituted. $R^1$ and $R^2$ radicals of any particular monomeric unit may differ from the corresponding functionalities of the next adjoining monomeric unit.

Typical quaternary ammonium softening agents comprise the compounds having the formula:

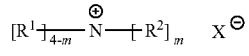

Wherein:

m is 1 to 3; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^2$ is independently a $C_{14}$-$C_{22}$ alkyl group, hydroxyalkyl group, hydrocarbyl or substituted hydrocarbyl group, alkoxylated group, benzyl group, or mixtures thereof; and $X^-$ is any quaternary ammonium-compatible anion.

In one example, each $R^1$ is methyl and $X^-$ is chloride or methyl sulfate and each $R^2$ is independently $C_{16}$-$C_{18}$ alkyl or alkenyl. Each $R^2$ may be independently straight-chain $C_{18}$ alkyl or alkenyl.

In another example, the quaternary ammonium compounds may be mono or diester variations having the formula:

$$(R^1)_{4-m}—N+-[(CH_2)_n—Y—R^3]_mX^-$$

wherein:

Y is —O—(O)C—, or —C(O)—O—, or —NH—C(O)—, or —C(O)—NH—, m is 1 to 3; n is 0 to 4; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^3$ is independently a $C_{13}$-$C_{21}$ alkyl group, hydroxyalkyl group, hydrocarbyl or substituted hydrocarbyl group, alkoxylated group, benzyl group, or mixtures thereof, and $X^-$ is any quaternary ammonium-compatible anion.

In one example, Y is —O—(O)C—, or —C(O)—O—; m=2; and n=2, each $R^1$ is independently a $C_1$-$C_3$, alkyl group, each $R^3$ is independently $C_{13}$-$C_{17}$ alkyl and/or alkenyl.

In another example, the quaternary ammonium compound may be an imidazolinium compound, such as an imidazolinium salt.

The softening lotion may comprise additional ingredients such as a vehicle as described herein below which may not be present in or on the tissue article. In one example, the softening lotion may comprise a vehicle such as water to facilitate the application of the softening agent onto the surface of the fibrous structure.

The softening lotion composition may also comprise other oils and/or emollients and/or waxes and/or immobilizing agents. In one example, the lotion composition comprises from about 10% to about 90% of an oil and/or liquid emollient and from about 10% to about 50% of immobilizing agent and/or from about 0% to about 60% of petrolatum and optionally the balance of a vehicle.

The softening lotion may be heterogeneous. It may contain solids, gel structures, polymeric material, a multiplicity of phases (such as oily and water phase) and/or emulsified components. The lotion compositions may be semi-solid, of high viscosity so they do not substantially flow without activation during the life of the product or gel structures. The softening lotions may be in the form of emulsions and/or dispersions.

In one example of a softening lotion, the lotion composition has a water content of less than about 20% and/or less than 10% and/or less than about 5% or less than about 0.5%. In another example, the lotion composition may have a solids content of at least about 15% and/or at least about 25% and/or at least about 30% and/or at least about 40% to about 100% and/or to about 95% and/or to about 90% and/or to about 80%, and combination of these values.

Immobilizing agents include agents that are may prevent migration of softening agent, softening lotion and/or the emollient into tissue such that the softening agent, softening lotion or emollient remain primarily on the surface of the tissue. Immobilizing agents may function as viscosity increasing agents and/or gelling agents. Examples of suitable immobilizing agents include waxes (such as ceresin wax, ozokerite, microcrystalline wax, petroleum waxes, fisher tropch waxes, silicone waxes, paraffin waxes), fatty alcohols (such as cetyl and/or stearyl alcohol), fatty acids and their salts (such as metal salts of stearic acid), mono and polyhydroxy fatty acid esters, mono and polyhydroxy fatty acid amides, silica and silica derivatives, gelling agents, thickeners and mixtures thereof.

In one embodiment, the softening lotion comprises at least one immobilizing agent and at least one emollient. In one example, the softening lotion comprises a sucrose ester of a fatty acid.

The softening lotion may be added to the tissue fibrous structure at any point during the papermaking and/or converting process. In one example, the lotion composition is added to the tissue during the converting process.

Typically, the softening lotion used in the invention is substantially non-transferable. The softening lotion composition may however also be a transferable lotion composition. A transferable lotion composition comprises at least one component that is capable of being transferred to an opposing surface such as a user's skin upon use. In one example, at least 0.1% of the transferable lotion present on the user contacting surface transfers to the user's skin during use.

Other optional components that may be included in the softening lotion include vehicles, perfumes, especially long lasting and/or enduring perfumes, antibacterial actives, antiviral actives, disinfectants, pharmaceutical actives, film formers, deodorants, opacifiers, astringents, solvents, cooling sensate agents, and the like. Particular examples of lotion composition components comprise camphor, thymol, menthol, chamomile extracts, aloe vera, *calendula officinalis*, alpha bisalbolol, Vitamin E, Vitamin E acetate or mixtures thereof.

Depressions—Embossments

In the article of the invention, the total surface area of the depressions is between 0.2% and 8% of the surface area of the article. The total surface area of the depressions (that is the sum of the surface areas of all depressions) can be between 0.4% and 6% or between 1% and 4% of the surface area of the article. It is believed that when the total surface area of the depressions is too low, the ply cohesion can not be maintained, i.e. the article delaminates in use. When the total surface area of the depressions is too high the softness of the article is dramatically and negatively impacted. It has been found that the above ranges are adequate to mitigate the possible delamination and the possible negative impact on softness. These ranges have been found to more specifically synergize with the other features of the invention such as the relative surface area of the network of depressions, to deliver enhanced softness.

In the article of the invention, the network of discrete depressions has a surface area between 60% and 100% of the surface area of the article, preferably between 70% and 100%, most preferably between 80% and 95%. In other words, the area covered by the network of depressions covers most of the surface area of the article. In one embodiment the network covers all the surface area of the article. The large coverage of the network induces that the plies are bonded over a vast surface area. The vast bonding area (network area) enhances the resistance to delamination of the article. Also the vast bonding area of the plies induces a certain degree of uniformity of the distribution of the depressions on the surface of the article. In one embodiment the discrete depressions are evenly distributed within the network of discrete depressions. It is contemplated that a certain degree of uniformity in the distribution of the depressions can be related to an enhanced softness of the article. Without being bound by the theory it is speculated that the surprising softness of the article of the invention is enhanced, in terms of bulkiness, by relatively small embossments (depressions), covering a relatively vast surface area of article, in a relatively uniform manner while creating a sufficient but not exaggerated ply adhesion of the lotioned tissue article.

The first ply of the article of the invention exhibits a separation force between 0.8 N/m and 20 N/m when separated from the article. The separation force is measured according to the method described in the below.

In some embodiments the separation force is between 1 N/m and 10 N/m or between 2 N/m and 7 N/m. The separation force of the plies is linked to several factors that include (i) the geometry of embossment protuberances and the resulting geometry of the depressions (size, shape, number of depressions, distribution, . . . ), (ii) the materials used in the plies (cellulosic fibers, synthetic fibers, combination thereof, basis weight of the plies . . . ), (iii) the presence of substances impacting the bonding of the plies (such as softening lotion on or in the plies, chemicals, additives, inks . . . ) and (iv) the embossing conditions (temperature, pressure applied, speed of the web, . . . ). It is believed that a separation force that is too high can be linked to fibers that are too much melted or fused together over a too wide surface area. This can induce a reduction of the perceived softness of the article by for example impacting the flexibility of the multiply article. On contrary a separation force that is too low is believed to promote ply delamination.

Optionally the adhesion between the plies can be enhanced by the presence of an adhesive between the plies. The adhesive can form a continuous or discontinuous layer between the plies. In one embodiment the discrete depressions colocate with discrete areas coated with the adhesive.

The combination of the claimed features, in the claimed ranges, have been surprisingly found to deliver an optimum reduction of the delamination of the plies together with an optimum and surprising perceived softness of the article. The perceived softness is thought to be linked to a number of physical factors including the smoothness of the surface or the article, the bulkiness of the article, the flexibility of the article, the resiliency of the article (ability to unfold when folded) and its caliper. The claimed ranges are thought to provide many sites of ply bonding (embossments/depressions), each site being of a relatively small dimension and the sites being distributed over a vast area of the surface of the article. The sites are as well in a relative proximity. Without being bound by the theory it is believed that the relatively many depressions in relatively close proximity forming a substantially uniform and vast network at the surface of the article promotes a material side-flow during the embossing process and increases the perceived bulkiness and the potentially perceived smoothness of the tissue, when sensed by the human hand.

In one embodiment of the invention the average surface area of the depressions is between 0.01 $mm^2$ and 16 $mm^2$, between 0.02 $mm^2$ and 4 $mm^2$ or between 0.1 $mm^2$ and 2 $mm^2$. Depressions of relatively small size are preferred as they are believed to induce a better "touch and feel" to the surface of the article. However depressions of very small surface area are thought to present enhanced risk to induce unwanted discontinuity of the surface of the article and/or tears of the ply.

In one embodiment the average distance between two adjacent depressions is between 1 mm and 20 mm, between 2 mm and 15 mm or between 5 mm and 7 mm. The relative proximity of the depressions, combined with their relatively small size has been found to enhance the quality of article as for its perceived softness.

Typical softening lotions have a negative impact on the bonding of the plies and enhance ply delamination. It is believed that the softening compounds of the lotions inhibit the fiber fusion or interlacing between the ply bonding/embossing processes. Softening lotion represents a significant cost in the manufacturing of the articles. Hence there is an incentive for using a relatively low amount of softening lotion. However a softening effect must be preserved by using a functional amount.

Brushing

It has been found in some embodiments that enhanced benefits can be measured when the external surface of the first ply of the article has been brushed. Brushing is a conventional process intended to create upstanding fibers at the surface of the ply and, hence, to increase the softness and/or downiness and/or smoothness of the ply. When a ply surface is brushed more upstanding loose fiber ends can be seen at the surface under the microscope than in a non-brushed surface. In one embodiment of the invention, one external surface of the article has been brushed, whereas as the inner surfaces have not been brushed. In one embodiment one external surface of the article has been brushed in a more stringent way (hence creating more upstanding fiber ends) than any other surface of the article. In one embodiment one external surface exhibits more fibers with upstanding loose ends than any other inwardly oriented surfaces of any ply of the article.

In one embodiment of the invention a single external surface of the article comprise an embossment. In another embodiment both external surfaces of the article comprise embossments. The depressions on each side of the article can, in one embodiment of the invention, correspond to each other (resulting for example to a so-called pin-to-pin embossment process). In other embodiments, the depressions on each sides are not phased, are randomly phased, or are inversely phased (meaning the depressions on one side correspond to a non-depression on the opposite external surface).

The invention includes the process for making the claimed product. In particular the invention relates to a manufacturing process comprising the steps of;

(i) providing a multiply tissue article having a first and a second ply, the tissue article having two external surfaces;

(ii) passing the article in between a first and a second embossing rolls under a pressure and a temperature. The first and second embossing rolls form a nip having a gap. The first embossing roll has discrete embossing protrusions forming a network of discrete protrusions, such as to create an embossment on one external surface of the first ply. The embossment comprises depressions (relative to non-embossed area), and forms a network of discrete depressions;

(iii) applying a softening lotion to the article.

The total surface area of the discrete protrusions is between 0.2% and 8% of the surface area of the first roll. The total surface area of the discrete protrusions can be between 0.4% and 6% or between 0.6% and 4% of the surface area of the first roll.

The network of protrusion has a surface area between 60% and 100% of the first roll and/or between 70% and 100%, and/or between 80% and 95%.

The embossing conditions (e.g. the pressure, temperature and gap) are further adjusted such as to create a separation force of the first ply between 0.8 N/m and 20 N/m. In some embodiments the separation force is between 1 N/m and 10 N/m or between 2 N/m and 7 N/m.

The second embossing roll can be made of a relatively softer material than the first embossing roll (for example: first roll hard steel, second roll rubber). Alternatively the second embossing roll can have a hard surface. The second embossing roll can present a smooth surface or alternatively can present protrusions. In one embodiment both roll have protrusions and create depressions on each external surface of the article. The protrusions on each roll can be phased to correspond (so-called pin-to-pin embossing), randomly phased, non-phased or inversely phased (the protrusions on one roll never matching a protrusion on the other roll).

The application of the softening lotion can be made by any conventional process, such as spraying, slot-coating, printing or impregnating the ply/plies. In one embodiment the lotion is only applied to the external surface(s) of the article and not on the inner plies or inner surfaces. In one embodiment the lotion is applied to the first ply of the article on its external surface.

In one embodiment of the invention the process further comprises the step of brushing at least one external surface of the article. The brushing process step can be made by any conventional process suitable for the treatment and preparation of tissue plies. Examples of such processes are the use of rotating brushes placed in contact of a moving web at a defined speed. In one embodiment the brushing step is applied after the multiply tissue article is provided. Alternatively the brushing step can be applied to a single ply before the combination of the plies to form the multiply tissue article. In one embodiment both external surfaces of the article are brushed.

Figure 2:
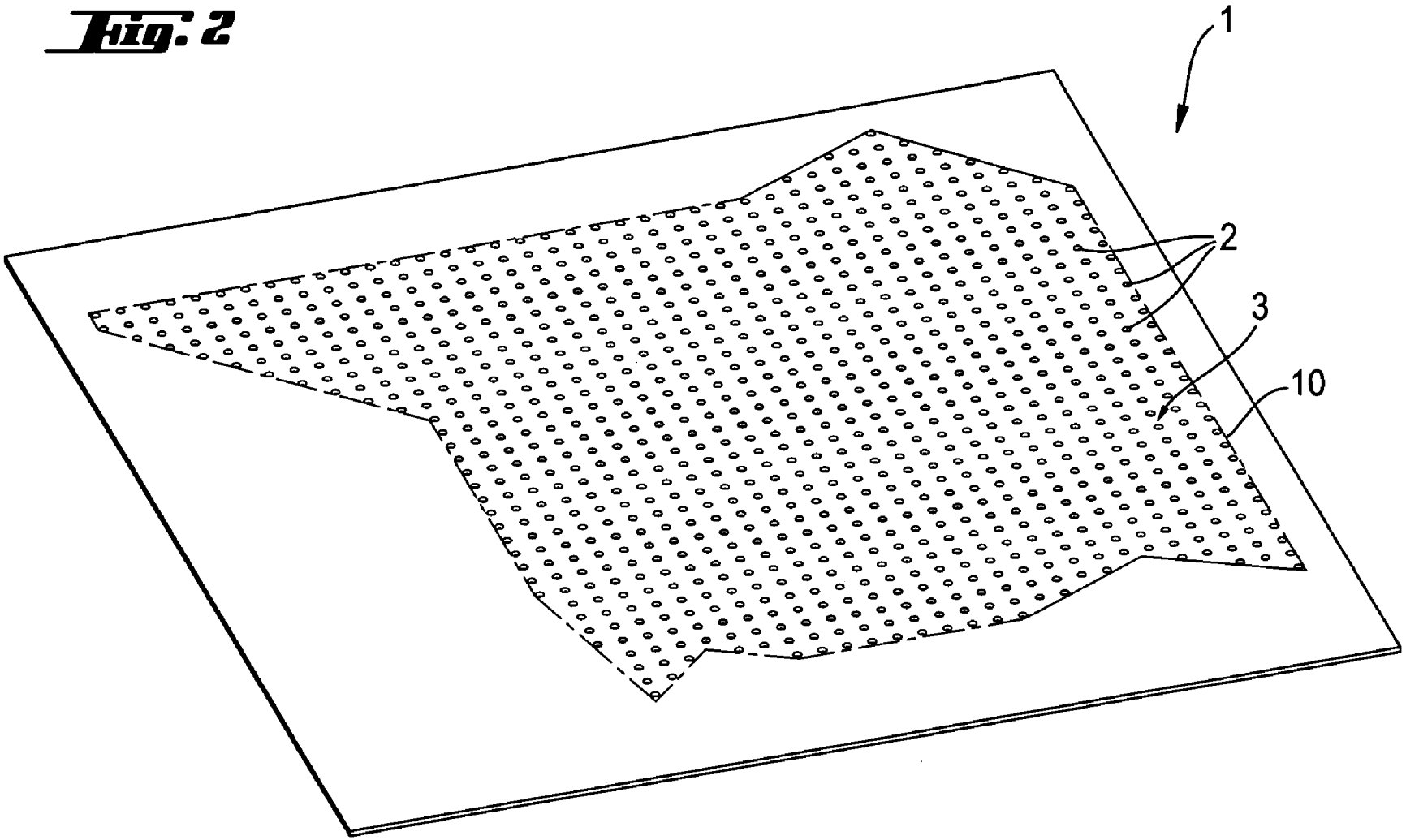
FIG. 2 is a schematic view of an article of the invention highlighting the network of depressions and its particular contour.

FIG. 1 shows a multiply tissue article (1) of the invention in the form of a paper handkerchief. Discrete depressions (2) are present on most of the surface area of the article (1) and form a network (3) of discrete depressions. In this embodiment the depressions are substantially evenly distributed within the network of depressions. The network (3) of discrete depressions is illustrated in another embodiment of the invention shown on FIG. 2 together with its contour (10)—defined by the smallest convex polygon comprising all discrete depressions.

Figure 3:
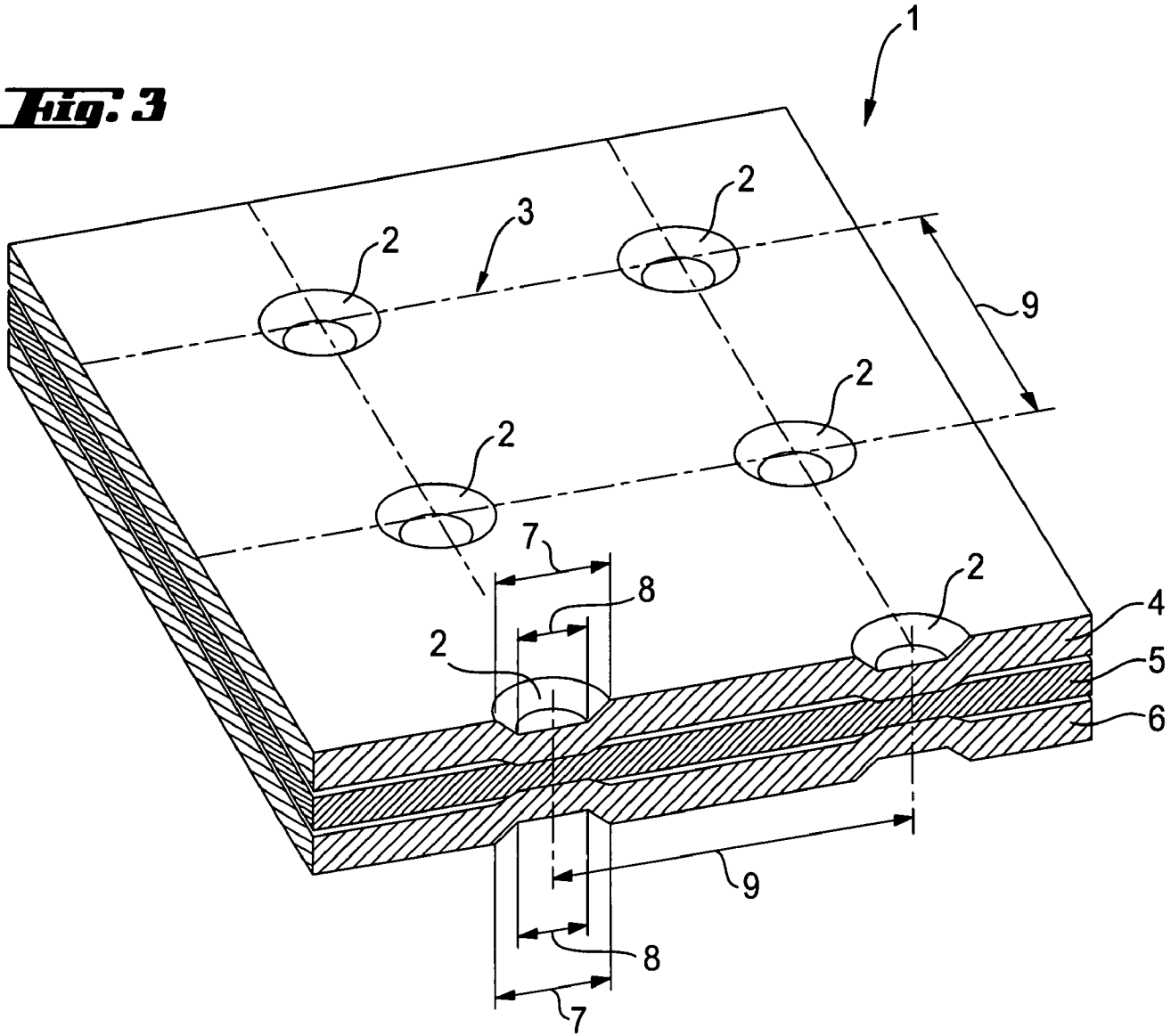
FIG. 3 is schematic section of an article of the invention showing the various plies and the depressions.

FIG. 3 shows a perspective section of the article of FIG. 1. In this embodiment the article has 3 plies (4), (5), (6). The external surface of the first ply (4) comprises depressions (2). The second external surface of the article, on the third ply (6) also comprises depressions (2'). The depressions (2) of the first ply (4) correspond to the depressions (2') of the third ply (6). Typically this type of embodiment is made by a pin-to-pin embossing process, embossing both external surface of the article in one process step. The depressions have inclined walls. Reference numeral (8) indicates the minimal surface area of the depression whereas reference numeral (7) indicates the maximal surface area of the depression. Reference numeral (9) indicates the distance between two adjacent depressions measured from their respective center.

Figure 4:
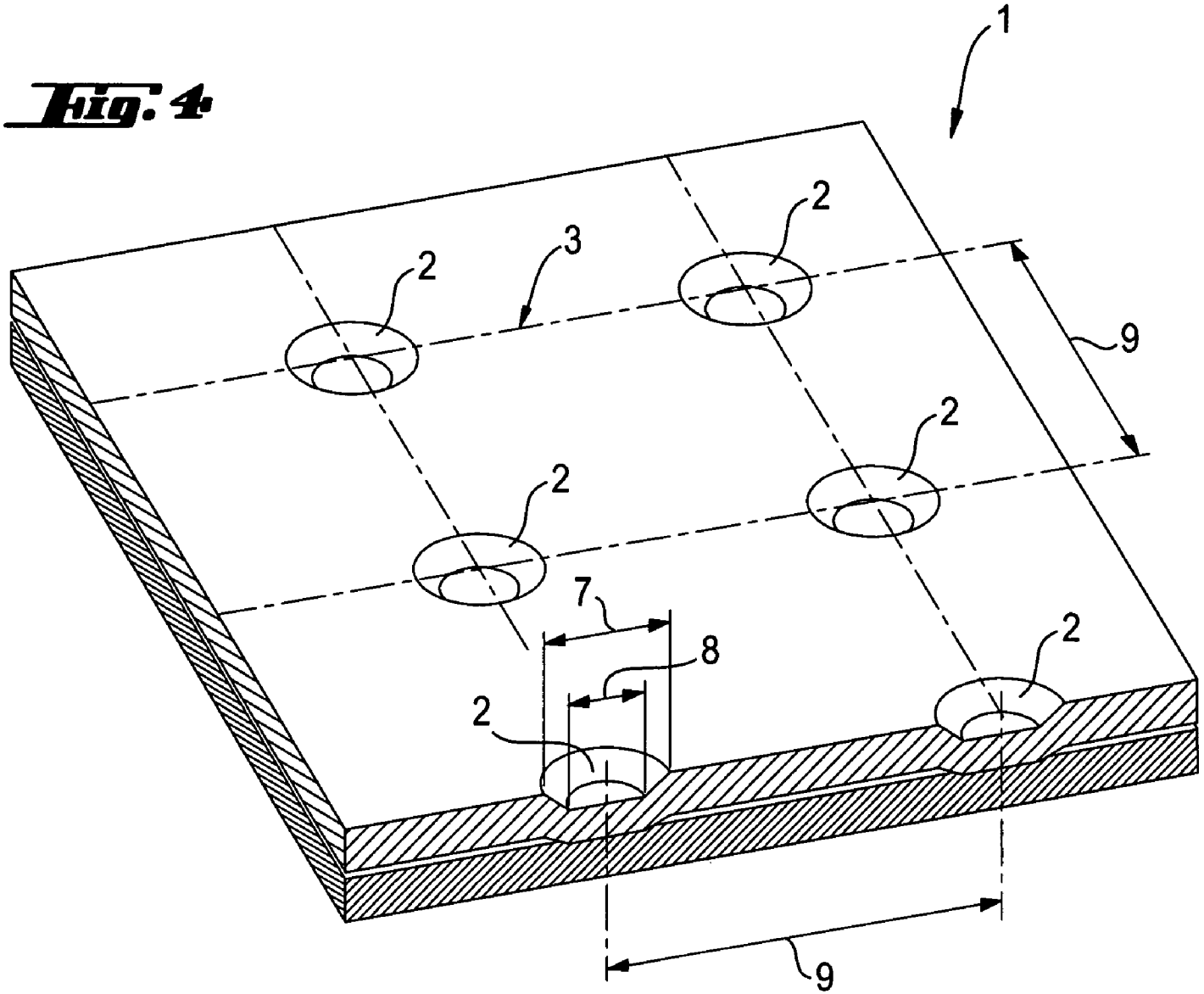
FIG. 4 is a schematic section of an article of the invention showing the various plies and depressions.

FIG. 4 shows a 2 ply article of the invention. In this embodiment, the depressions (2) are only present at one external surface of the article. Typically this type of embodiment is made by a pin-to-flat embossing process.

Figure 5:
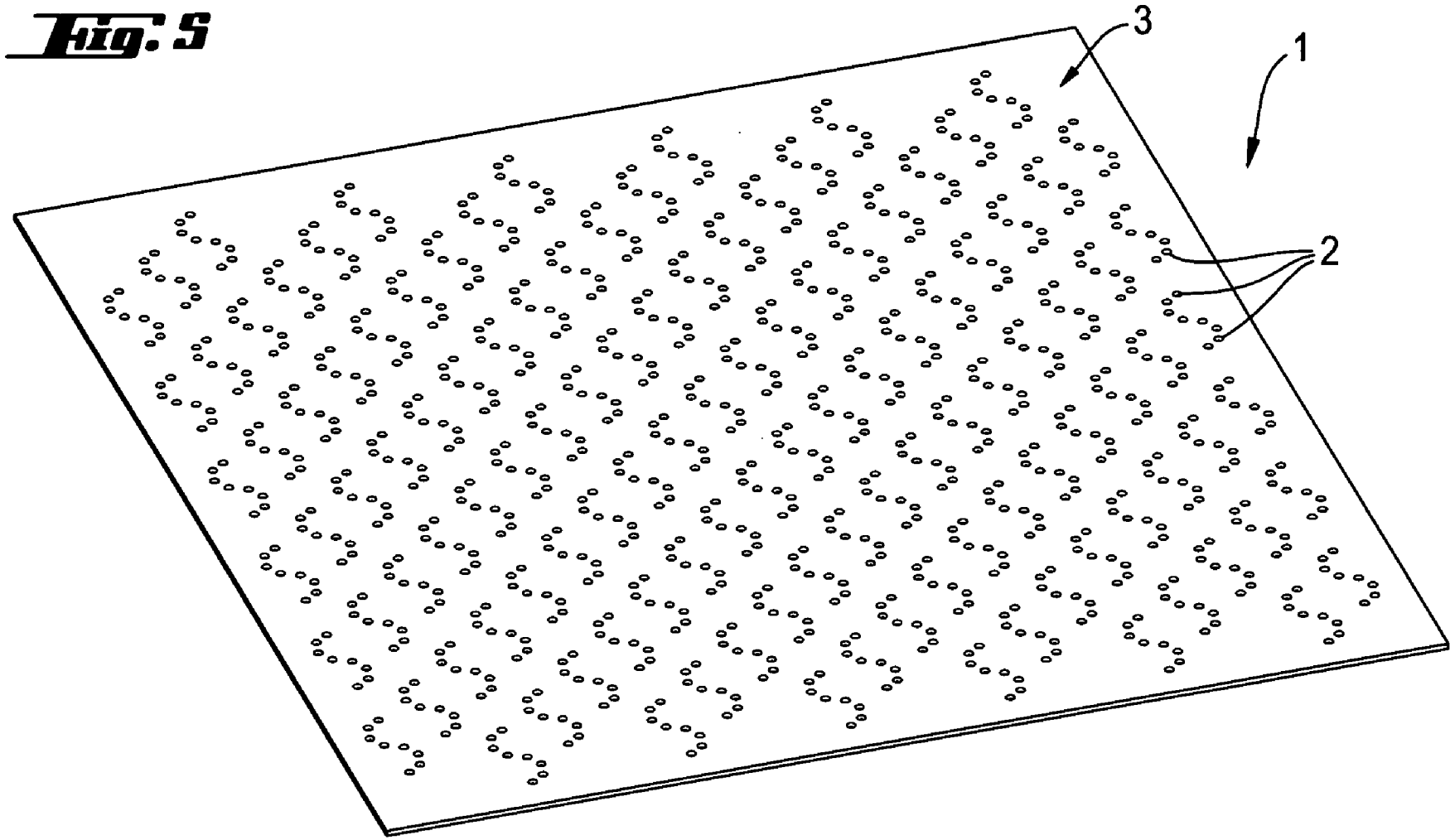
FIG. 5 is a schematic view of one embodiment of the article of the invention showing the network of depressions.

FIG. 5 is a schematic view of one embodiment of the article (1) of the invention showing a particular network (3) of discrete depressions (2) embossed at the external surface of the article. In this embodiment the depressions are arranged in groups, each group having a "S" shape. The groups are substantially evenly distributed within the network of depressions.

Figure 6:
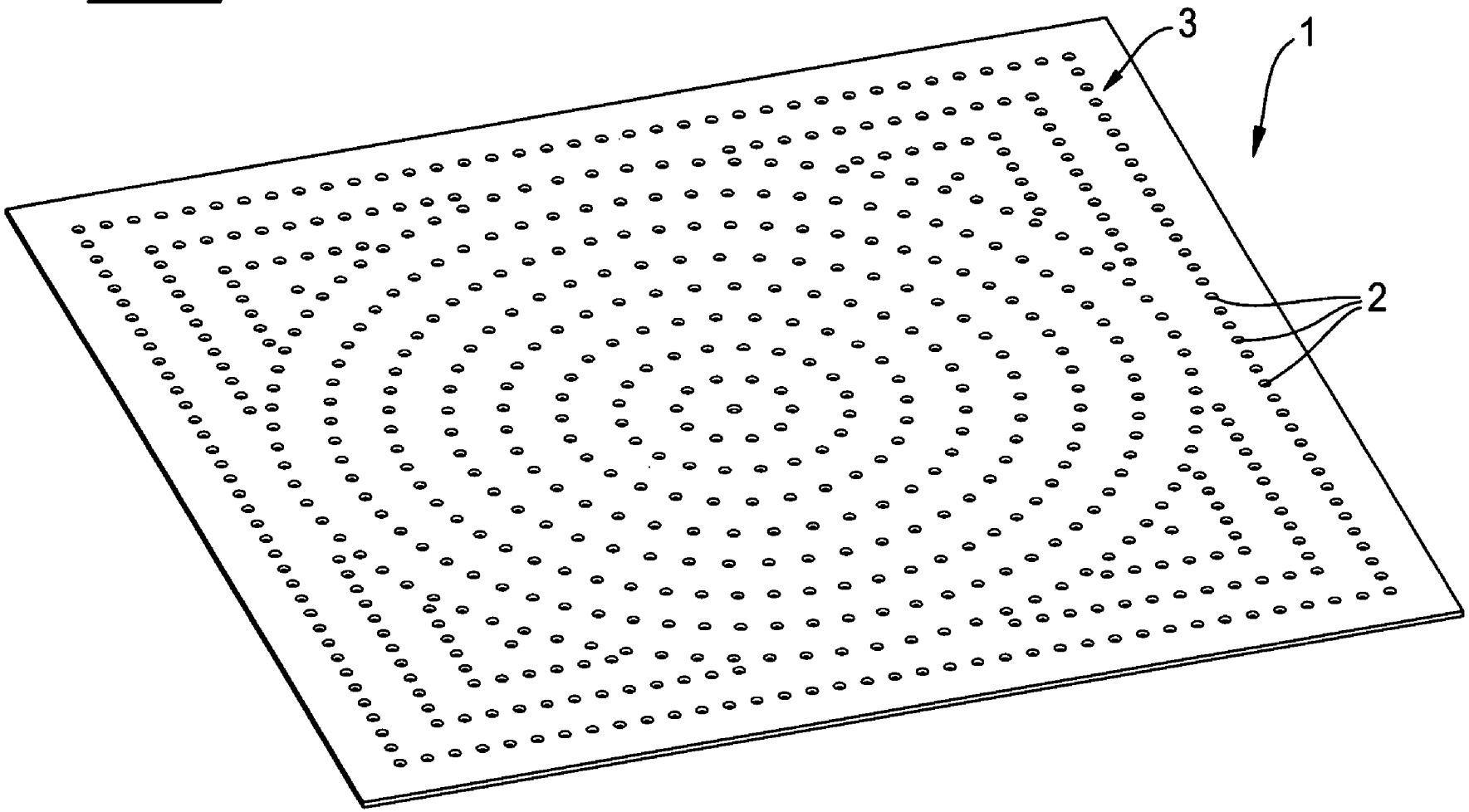
FIG. 6 is a schematic view of one embodiment of the article of the invention showing the network of depressions

FIG. 6 is a schematic view of another embodiment of the invention showing a particular network (3) of discrete depressions (2) embossed at the external surface of the article. In this embodiment the depressions are not evenly distributed within the network of depressions but create some visible particular patterns ("O" shapes, "L" shapes).

EXAMPLES

The following samples showing the characteristics given in the below tables.

TABLE 1

| Sample | Substrate | Softening lotion, % silicon softening agent as "weight of active/weight of paper" | Embossing pattern | brushing | Basis weight (g/sqm) | caliper, mm | Ply separation force, average maximum load, N/m | Overall performance according to evaluation by experts |
|---|---|---|---|---|---|---|---|---|
| A1 | C1 | None | None | None | 59.8 | 0.30 | <0.5 | Intermediate |
| T2 | C1 | None | small T | None | 58.1 | 0.29 | 1.5 | Low |
| C5a | C1 | 0.23% | None | None | 59.3 | 0.29 | <0.5 | Low |
| T4 | C1 | 0.31% | small T | None | 58.7 | 0.29 | 1.1 | High |

TABLE 1-continued

| Sample | Substrate | Softening lotion, % silicon softening agent as "weight of active/weight of paper" | Embossing pattern | brushing | Basis weight (g/sqm) | caliper, mm | Ply separation force, average maximum load, N/m | Overall performance according to evaluation by experts |
|---|---|---|---|---|---|---|---|---|
| T5 | C1 | 0.31% | small T | Yes | 57.2 | 0.29 | 2.2 | High |
| B1 | W5 4ply | None | None | None | 58.6 | 0.27 | <0.5 | Intermediate |
| B2c | W5 4ply | None | hashur c | None | 57.6 | 0.3 | 6.5 | Low |
| B6c | W5 4ply | 0.19% | None | None | 59.2 | 0.28 | <0.5 | Low |
| B5c | W5 4ply | 0.19% | hashur c | None | 59.0 | 0.28 | 3.1 | High |
| B4c | W5 4ply | 0.25% | hashur c | Yes | 58.1 | 0.29 | 4.4 | High |
| B2d | W5 4ply | None | hashur d | None | 58.3 | 0.25 | 4.5 | Low |
| B6d | W5 4ply | 0.19% | None | None | 58.9 | 0.28 | <0.5 | Low |
| B5d | W5 4ply | 0.19% | hashur d | None | 58.6 | 0.27 | 1.4 | High |
| B4d | W5 4ply | 0.25% | hashur d | Yes | 58.4 | 0.28 | 2.1 | High |
| E2 | C1 | none | Product E hashur | None | 58.9 | 0.29 | 1.6 | Low |
| D5 | C1 | 0.23% | Product E hashur | None | 59.3 | 0.29 | 1.6 | High |
| D4 | C1 | 0.23% | Product E hashur | Yes | 58.7 | 0.29 | 2.1 | High |

The embossing characteristics of the samples are as follows:

TABLE 2

| Embossing pattern | small T | hashur c | hashur d | Product E hashur |
|---|---|---|---|---|
| Samples | T2, T4, T5 | B2c, B5c, B4c | B2d, B5d, B4d | E2, D5, D4 |
| Embossing type | pin to flat | pin to pin | pin to pin | pin to pin |
| Dimensions of discrete depression | depressions have a "T" shape; max width 7 mm × mini width 0.4 mm | 0.45 mm × 1.2 mm | 0.3 mm × 0.8 mm | 2 mm × 2 mm |
| Average surface area of discrete depressions ($mm^2$) | 12 | 0.54 | 0.24 | 4 |
| Density of depressions(number per 100 $cm^{2)}$ | 50 | 1000 | 250 | 50 |
| total surface of all discrete depression ($mm^2$)- Article surface area is 43680 $mm^2$ | 2621 | 2359 | 262 | 874 |
| % total surface area of discrete depressions over surface area of article | 6.0% | 5.4% | 0.6% | 2.0% |
| % surface area of network of discrete depressions over total surface area of article | 80% | 80% | 80% | 80% |
| Average distance between 2 adjacent depressions(mm) | 14.5 | 3.5 | 7.75 | 17.25 |

Although the tissue of the invention can be made from various paper making technologies (such as Through-air dry paper, creped or uncreped, etc. . . . ), all samples of the above examples are made of a paper substrate made according to conventional paper making technology and using a creping process. Conventional paper making as well as creping are widely described in the art.

The tissues of the above examples are made by using layering technology, as widely known in the art. A layer comprises relatively short fibers (e.g. eucalyptus fibers) and provides a tissue side being relatively soft. The second layer, corresponding to the other side of the tissue, comprises preferentially long fibers such as Northern Kraft. Such fibers impart strength to the tissue. The thickness of this layer varies from 20 to 100 mμ.

Basis weight of the individual tissue plies ranges from 8 to 40 g per ply. The tissue comprises softener chemicals (quaternary ammonium compounds) as known in the art, which are added to the soft fiber side. The tissue also comprises wet strength agents, as known in the art, which are added to the long fiber side.

The multiply tissue substrate with the code name "W5" is a 4 ply product. The substrate is layered and the upper or bottom ply is turned in order to create a multiply article in which both outer sides consists of soft fibers. The basis weight per ply is about 15 g/m$^2$. The softwood layer is about 60% and the long fiber side is about 40%.

The multiply tissue substrate with the code name "C1" is a 3 ply product. The basis weight per ply is about 20 g/m$^2$. The 3$^{rd}$ ply has is turned to create two outer sides which feel very soft while the inner side feels rougher. The softwood side is about 70% while the long fiber side is about 30%.

Some of the tissues of the examples, as indicated in the tables, are subjected to a brushing treatment during the converting phase of the manufacturing: A tissue as described above is used and then converted with a brushing step in order to impart particular surface characteristics to the tissue. The brushing operation involves diving a rotating brush roll that comprises bundles of bristles onto the passing tissue web. The tissue is guided by a guide roll forming an S-wrap. The brush rolls spin with high rotational speed in the direction to the movement of the web. The bristles are made of polyamide fibers with a diameter of 60 to 500 mμ diameter and a length of 18 to 50 mm; the numbers of hairs is from 300 to 5000 per cm$^2$. A typical set up as used in the examples is: brush roll diameter 20 cm. The web hold by guide rolls (S-wrap). The bristles of the brushes dive 400 μm into the web and the brush roll is spinning with 4000 rotations per minute in machine direction while the web is transported with a speed of 200 m/min through the machine. The bristles length is about 12 mm and the number of bristles per cm$^2$ is about 400. The brushing step is applied after the embossing step.

The silicone lotion used in the examples, as indicated in the tables, has the trade name LBA/MR102 and has material number 60007095 as supplied by Wacker-Chemie GmbH, Hanns-Seidel-Platz 4, D-81737 München—Germany. The lotion application is made by slot extrusion of the lotion onto the passing web after the embossing and brushing steps at the addition level indicated in table 1. The lotion material LBA/MR102 is diluted to 6.25% of silicone softening agent in water. The necessary amount is then applied to the tissue to obtain the concentration of softening agent in the tissue article (w/w) as shown in table 1.

In some of the examples, and according to the invention, the tissue is subjected to an embossing step. The tissue web was passed in between 2 embossing rolls. For some examples indicated as "pin-to-flat", one of the roll has a tri-dimensional surface comprising embossing protuberances (pins). The other roll has a substantially flat surface. In some other examples, indicated as "pin-to-pin" both rolls have corresponding protuberances. The rotating speed of the rolls is adjusted to correspond to the linear speed of the web passing in between the rolls. A pressure of around 5'000 psi (for both pin-to-flat and pin-to-pin) is maintained between the rolls.

The embossing step provides the tissue with a particular pattern (corresponding to the pin configuration on the embossing roll): In the examples the patterns used are "small T" (having the general shape of an uppercase T), "hashur c", hashur d" or "product E hashur". Each type having a different shape and size, according to table 1.

The embossing step provides the web with the characteristics described in table 2. As such it can be seen that samples T4, T5, B5c, B4c, B5d, B4d, D5, and D4 are part of the present invention and exhibited improved performance as mentioned in the column titled "overall performance as per expert panel evaluation" of Table 1. The rating for "overall performance" is a measure of primarily the softness and the strength (considered together) of the article. It also integrates the contribution of smoothness, tensile strength, ply bonding, bulkiness and comfort of use. The samples A1, T2, C5a, B1, B2c, B6c, B2d, B6d and E2 are made according to prior art.

From the above examples, the following comparisons, among others, can be meaningful:

Sample A1 is outside the present invention and exhibit an intermediate level of overall performance. Sample T4 made according to the present invention comprised a softening lotion and is embossed. It exhibits a high overall performance.

Comparison between sample B6c (prior art) and B5c (invention) shows the effect of the embossing according to the invention as well as the increased performance of the sample.

Comparison between samples E2 (prior art) and D5 and D4 (both according to the invention) illustrates the benefits of the lotioning, embossing, and of the brushing step.

The effect of the brushing step, in combination of the other features of the invention, is also seen when comparing samples B6d (prior art) to sample B4d (invention). B4d exhibits a higher level of overall performance versus B6d.

Methods:

Calculation of the Surface Area of a Depression:

When the embossments have straight walls, the surface area of a depression can be easily measured, for example under the microscope. In case the embossments have inclined walls the surface area of a depression is the average between the minimal surface area (typically at the deepest distal zone of the depression) and its maximal surface area (typically at the proximal zone of the depression). Typically, the surface of the depressions corresponds approximately to the surface of the embossing protuberances on the embossing rolls.

Total Surface Area of Depressions:

The surface area of all individual depressions or of a statistically significant number of depressions are added together to provide the total surface area of depressions on the article. An approximation can be obtained by multiplying the density of depressions by the average surface area of a depression (in case all depressions have identical/similar dimensions). The total surface area of depressions is expressed as a % of the total surface area of the article.

Surface Area of the Network of Depressions:

The surface area of the smallest polygon comprising all depression is measured and calculated. If the polygon comprises zones without depressions, the surface area of the zones without depressions is measured and subtracted from the surface area of the polygon. The resulting figure is the surface area of the network of depressions. The surface area of the network of depressions is expressed as a % of the total surface area of the article.

Distance Between Two Adjacent Depressions:

The distance between two adjacent depressions is measured from and to the center of the depressions. The average distance is then calculated by measuring a statistically significant number of depressions and their adjacent neighbors.

The surface area of the article is obtained by simple physical measurement of its dimensions.

Separation Force Measurements:

This method is to measure the average peel force required to separate the plies of a multiply tissue article. The separation force is quantitatively determined on a 25.4 mm (1 inch) wide usable unit of the multiply tissue article using an electronic tensile tester. The multiply tissue article to be measured is cut into sample stripes of 25.4 mm (1 inch) width. The method can be adapted easily to handle samples of smaller size using conventional analytical knowledge. The single plies are separated on the edges of the articles and clamped into the upper and lower clamp of the tensile tester. If the article comprises more than 2 plies, two plies are fixed into the bottom clamp and the remaining ply or plies are fixed into the upper clamps of the tensile tester. The peeling angle is 180°. The tensile tester peels the sample apart with a constant peeling speed of 254 mm/min (10 Inch/min). After 1.27 mm (0.05 Inch) pre-peeling (2.54 mm (0.1 inch) test distance) the load-cell of the tensile tester captures the force across a sample distance of 152.4 mm (6 Inch). The measurement distance is 304.8 mm (12 inches). If article size is smaller, the measurement distance is adapted to 85% of the sample size.

Apparatus

| | |
|---|---|
| Conditioned Room | Temperature and humidity controlled with the following limits:<br>Temperature: 73 ± 2° F. (23 ± 1° C.)<br>Relative humidity: 50 ± 2% |
| Tensile Tester | Thwing Albert Vantage Tensile Tester, Serial# 52207<br>Thwing-Albert Instrument Company<br>14 Collings Avenue<br>W.Berlin, NJ 08091, USA |
| Load Cell | Thwing Albert # 5 (5 N), Serial# 170467, |
| Ultra light clamp | Thwing Albert, |
| Calibration weights | Calibration weights for 100% load cell range, |
| Software | MAP 3.0 Thwing Albert, or equivalent |
| Gauge Block | For Pre-Test-Adjustment, Length 25.4 (1 inch) |
| Cutter | Width 25.4 mm (1 inch) |
| Tweezers | |

Samples are to be conditioned with all wrapping or packaging materials removed in a conditioned room with temperature controlled to 73±2° F. (23±1° C.) and relative humidity of 50±2% for a minimum of two hours.

Sample Preparation: Stack the articles to be measured and place them on the paper cutter. When the fabric side is recognizable by the expert person, place the fabric side up in Machine Direction (MD) (fabric side and machine direction refers to the manufacturing conditions of the paper). Cut 2 stripes with a width of 25.4 mm (1 inch) out of each sheet. The cut surface needs to be chosen, such that the cut embossing area is almost identically for each stripe and the mid sheet folding is not a part of the sample. Separate the single plies with tweezers and place in the clamps.

Operation:

Calibration Procedure: Perform the calibration procedure prior measuring a sample sequence, according to manufacturer instructions.

Pre-test Adjustment: With the Pre-test the Gauge length is adjusted. Place the Gauge block on the lower grip and start the pre-adjustment. The upper grip moves down until it reaches the gauge block. Afterwards it sets up to the gauge length for testing procedure.

Measurement Procedure:

Set the tensile tester distance lower clamp to upper clamp to 38.1 mm (1.5 Inch).

Fix the ply or plies of the article in the top clamp and the other/ply plies into the bottom clamp of the tensile tester Zero the Load Cell Start the measurement Repeat measurements to obtain a total of 12 individual tests (i.e. 12 replicates) per sample

| Tensile Tester Setting | |
|---|---|
| Load Cell | 5 N |
| Speed | 254 mm/min (10 Inch/min) |
| Pre-test Distance | 2.54 mm (0.1 Inch) |
| Test Distance | 304.8 mm (12 Inch) |
| Load Divider | 1 |

Reporting Results As result the applied force over test length of 152.4 mm (6 Inch) sample length is graphically recorded. The highest force peak across the measurement distance (max load) is reported in Newton per meter [N/m].

What is claimed is:

1. A multiply tissue article comprising a first and a second ply, said first ply comprising an external surface of said article, said article comprising a softening lotion and an embossment on said external surface of said first ply, said embossment forming a network of discrete depressions, characterized in that the total surface area of said discrete depressions is between about 0.2% and about 8% of the surface area of said article, said depressions having a depth that is between about 20 μm and about 500 μm and the average surface area of said depressions is between about 0.01 $mm^2$ and about 16 $mm^2$, and said network is between about 60% and about 100% of the surface area of said article, and said first ply exhibits a separation force of between about 0.8 N/m and about 20 N/m when separated from the article.

2. The multiply tissue article of claim 1 wherein said softening lotion comprises a silicon-based softening agent.

3. The multiply tissue article of claim 2 wherein the basis weight of said multiply tissue article is between about 10 grams per square meter (gsm) and about 80 grams per square meter (gsm).

4. The multiply tissue article of claim 1 wherein said discrete depressions are evenly distributed within said network of depressions.

5. The multiply tissue article of claim 1 wherein said softening lotion comprises a quaternary ammonium softening agent.

6. The multiply tissue article of claim 1 wherein the average distance between two adjacent depressions is comprised between about 1 mm and about 20 mm.

7. The multiply tissue article of claim 1 wherein said at least one tissue ply is made by a wet-laying paper making process of wood fibers and is optionally layered.

8. The multiply tissue article of claim 1 wherein said softening lotion comprises a softening agent, said agent being between about 0.02% and about 25% weight/weight of said article.

9. The multiply tissue article of claim 1 wherein said external surface of said first ply of said article exhibits more fibers with upstanding loose ends than any inwardly oriented surfaces of any ply of said article.

10. The multiply tissue article of claim 1 wherein said second ply comprises a second external surface of said article and said second ply comprises an embossment on said second external surface, said embossment comprising depressions.

11. A multiply tissue article of claim 10 wherein said depressions of said first ply correspond to said depressions of said second ply as the result of a pin-to-pin embossment process.

12. A process for making a multiply tissue article according to claim 1, comprising the steps of:

providing a multiply tissue article comprising a first and a second ply, said first ply comprising an external surface of said article, passing said article in between a first and a second embossing rolls under a pressure and temperature, said first and second embossing rolls forming a nip having a gap, said first embossing roll having discrete embossing protrusions forming a network of discrete protrusions, such as to create an embossment on said external surface of said first ply, said embossment forming a network of discrete depressions, applying a softening lotion to said article, wherein the total surface area of said discrete protrusions is between about 0.2% and about 8% of the surface area of said first embossing roll, and the corresponding depressions have a depth that is between about 20 μm and about 500 μm and the average surface area of said depressions is between about 0.01 $mm^2$ and about 16 $mm^2$, and wherein said network of protrusions has a surface area between about 60% and about 100% of the surface area of said first roll, characterized in that said process further comprises the step of:

adjusting said pressure, temperature and gap such as to create a separation force between about 0.8 N/m and about 20 N/m when said first ply is separated from said article.

13. The process of claim 12 wherein said second roll comprises embossing protrusions and imparts depressions on the surface of said article.

14. The process of claim 13 wherein said protrusions on said second roll correspond to said protrusions on said first roll.

15. The process of claim 12 further comprising the step of brushing at least one external surface of said article.

16. The multiply tissue article of claim 1 wherein said first ply exhibits a separation force of between about 1 N/m and about 10 N/m when separated from the article.

17. The multiply tissue article of claim 16 wherein said first ply exhibits a separation force of between about 2 N/m and about 7 N/m when separated from the article.

18. The multiply tissue article of claim 1 wherein said depressions have a depth that is between about 50 nm and about 300 nm.

19. The multiply tissue article of claim 18 wherein said depressions have a depth that is between about 80 nm and about 180 nm.

20. The multiply tissue article of claim 1 further comprising an agent selected from the group consisting of antibacterial actives, antiviral actives, and cooling sensate agents.

* * * * *